US007036571B2

(12) United States Patent
Kamiyama et al.

(10) Patent No.: US 7,036,571 B2
(45) Date of Patent: May 2, 2006

(54) COMPOUND TYPE HEAT EXCHANGER

(75) Inventors: Naohisa Kamiyama, Ashikaga (JP); Toshiharu Watanabe, Sano (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/842,155

(22) Filed: May 10, 2004

(65) Prior Publication Data

US 2005/0006081 A1 Jan. 13, 2005

(30) Foreign Application Priority Data

May 15, 2003 (JP) ..... 2003-137645

(51) Int. Cl.
*F28F 9/26* (2006.01)

(52) U.S. Cl. ..... 165/174; 165/140; 165/176

(58) Field of Classification Search ..... 165/140, 165/174, 176, 144
See application file for complete search history.

(56) References Cited

U.S. PATENT DOCUMENTS 2,505,790 A * 5/1950 Panthofer ..... 165/140
5,690,166 A * 11/1997 Yamaguchi ..... 165/96
6,035,927 A * 3/2000 Krauss et al. ..... 165/135
6,394,176 B1 * 5/2002 Marsais ..... 165/140
6,510,893 B1 * 1/2003 Naji et al. ..... 165/135
6,793,012 B1 * 9/2004 Fang et al. ..... 165/140
6,883,600 B1 * 4/2005 Mano et al. ..... 165/174
2002/0023743 A1 * 2/2002 Jung et al. ..... 165/173
2002/0040776 A1 * 4/2002 Kokubunji et al. ..... 165/140
2003/0085027 A1 * 5/2003 Koyama ..... 165/140

FOREIGN PATENT DOCUMENTS

EP 0 859 209 * 8/1998
JP 2000-018880 1/2000

* cited by examiner

*Primary Examiner*—Teresa J. Walberg
(74) *Attorney, Agent, or Firm*—Kilpatrick Stockton LLP

(57) ABSTRACT

A compound type heat exchanger has a core part including a plurality of heat exchanging tubes and fins juxtaposed and alternately stacked. Header pipes are connected to the heat exchanging tubes at both ends of the heat exchanging tubes. A pseudo heat exchanging passage member having a substantially L-shaped or Z-shaped section is arranged in place of a specified heat exchanging tube of the heat exchanging tubes and a fin or both fins adjoining the specified heat exchanging tube. At the boundary of the pseudo heat exchanging passage member, the core part is divided into two parts, defining an oil cooler unit and a condenser unit. Owing to the provision of the pseudo heat exchanging passage member in the core part, heat conduction from the oil cooler unit to the condenser unit can be suppressed.

7 Claims, 7 Drawing Sheets

COMPOUND TYPE HEAT EXCHANGER

BACKGROUND OF THE INVENTION

The present invention relates to a compound type heat exchanger having a plurality of independent heat exchanging units, such as condenser and oil cooler, integrated with each other.

Normally, an automobile is equipped with some heat exchanging units, for example, a radiator for cooling an engine, an air conditioning condenser, an oil cooler for cooling automatic transmission oil (i.e. ATF oil cooler), an oil cooler for cooling engine oil and so on. Hitherto, the above radiator and the condenser are individually arranged in the front area of an engine. Recently, in view of reducing the installation space of such units for purpose of the downsizing of an engine and also reducing the number of assembling steps of the units, a compound type heat exchanger where a condenser and an oil cooler are integrated in one body has been developed.

In the compound type heat exchanger, however, there is a great difference in temperature between a heat exchanging medium flowing the condenser and oil flowing the oil cooler. Therefore, Japanese Patent Application Laid-open No. 2000-18880 discloses a compound type heat exchanger provided, between a condenser and an oil cooler, with a pseudo heat exchanging passage member in which such a heat exchanging medium does not flow.

In the above-mentioned compound type heat exchanger, however, fins are connected to both sides of the pseudo heat exchanging passage member by means of brazing. Therefore, there is a possibility that heat of oil flowing the oil cooler is transmitted to the heat exchanging medium flowing the condenser to deteriorate the heat exchanging efficiency of the heat exchanger.

SUMMARY OF THE INVENTION

In the above-mentioned situation, it is an object of the present invention to provide a compound type heat exchanger having a plurality of heat exchanging units, which can suppress heat conduction from the heat exchanging unit of high temperature to the heat exchanging unit of low temperature.

In order to attain the above object, according to the first aspect of the invention, there is provided a compound type heat exchanger, comprising: a core part having a plurality of heat exchanging tubes each formed to allow passage of a heat exchanging medium therein, the heat exchanging tubes being juxtaposed to each other, and a plurality of fins each interposed between the adjoining heat exchanging tubes so that the heat exchanging tubes and the fins are laminated alternately; a pair of header pipes arranged on both ends of the heat exchanging tubes and connected to respective ends of the heat exchanging tubes; a pseudo heat exchanging passage member formed so as not to allow passage of the heat exchanging medium therein and arranged so as to substitute for a specified heat exchanging tube of the heat exchanging tubes and a fin adjoining the specified heat exchanging tube on either left or right side thereof, the pseudo heat exchanging passage member having a substantially L-shaped section; and partition walls each arranged in the header pipes so as to be close to the pseudo heat exchanging passage member thereby to divide spaces inside the header pipes in a direction perpendicular to the longitudinal direction of the header pipes, wherein the core part and the header pipes are divided in a direction perpendicular to the laminating direction of the heat exchanging tubes and the fins at a boundary of the pseudo heat exchanging passage member into a first heat exchange unit and a second heat exchange unit.

With the above-mentioned constitution, since the pseudo heat exchanging passage member having the substantially L-shaped section is arranged in place of the specified heat exchanging tube and the fin adjoining the specified heat exchanging tube, the pseudo heat exchanging passage member comes into line-contact or point-contact with the heat exchanging tube or the fin adjoining the pseudo heat exchanging passage member. Accordingly, the quantity of heat conduction produced between the first heat exchanging unit and the second heat exchanging unit is reduced remarkably, whereby the heat exchanging performance of the heat exchanger as a whole can be maintained highly. Noted, such an elimination of the fin would make the flow of cooling wind passing through the core part smooth thereby reducing the draft resistance too much. Nevertheless, according to the preferred embodiment, the pseudo heat exchanging passage member having the substantially L-shaped section serves to suppress such an excessive reduction of draft resistance.

In another preferred embodiment, the pseudo heat exchanging passage member is provided, on one side thereof in the laminating direction, with projections that abut on the heat exchanging tube adjoining the pseudo heat exchanging passage member.

In this case, since the contact area between the pseudo heat exchanging passage member and the heat exchanging tube or the fin is reduced furthermore, it is possible to reduce the quantity of heat conduction between the first heat exchanging unit and the second heat exchanging unit, whereby the heat exchanging performance of the heat exchanger as a whole can be maintained highly.

According to the second aspect of the invention, there is also provided a compound type heat exchanger, comprising: a core part having a plurality of heat exchanging tubes each formed to allow passage of a heat exchanging medium therein, the heat exchanging tubes being juxtaposed to each other, and a plurality of fins each interposed between the adjoining heat exchanging tubes so that the heat exchanging tubes and the fins are laminated alternately; a pair of header pipes arranged on both ends of the heat exchanging tubes and also connected to respective ends of the heat exchanging tubes; a pseudo heat exchanging passage member formed so as not to allow passage of the heat exchanging medium therein and arranged so as to substitute for a specified heat exchanging tube of the heat exchanging tubes and a fin adjoining the specified heat exchanging tube on either left or right side thereof, the pseudo heat exchanging passage member having a substantially Z-shaped section; and partition walls each arranged in the header pipes so as to be close to the pseudo heat exchanging passage member thereby to divide spaces inside the header pipes in a direction perpendicular to the longitudinal direction of the header pipes, wherein the core part and the header pipes are divided in a direction perpendicular to the laminating direction of the heat exchanging tubes and the fins at a boundary of the pseudo heat exchanging passage member into a first heat exchanging unit and a second heat exchanging unit.

With the above-mentioned constitution, since the pseudo heat exchanging passage member having the substantially Z-shaped section is arranged in place of the specified heat exchanging tube and the fin adjoining the specified heat exchanging tube, the quantity of heat conduction produced between the first heat exchanging unit and the second heat exchanging unit is reduced remarkably, whereby the heat exchanging performance of the heat exchanger as a whole can be maintained highly. As similar to the first aspect of the invention, such an elimination of the fin would make the flow of cooling wind passing through the core part smooth thereby reducing the draft resistance too much. Nevertheless, according to the present invention, the pseudo heat exchanging passage member having the substantial Z-shaped section serves to suppress such an excessive reduction of draft resistance.

In a preferred embodiment, the pseudo heat exchanging passage member is arranged so that both ends thereof in the laminating direction do not abut on the heat exchanging tubes adjoining the pseudo heat exchanging passage member.

In this case, since no contact area is produced between the pseudo heat exchanging passage member and the heat exchanging tubes on both sides of the pseudo heat exchanging passage member, it is possible to reduce the quantity of heat conduction between the first heat exchanging unit and the second heat exchanging unit, whereby the heat exchanging performance of the heat exchanger as a whole can be maintained highly.

The pseudo heat exchanging passage member is provided, on one end thereof in the laminating direction, with projections that abut on the heat exchanging tube adjoining the pseudo heat exchanging passage member.

In this configuration, since the contact area between the pseudo heat exchanging passage member and the heat exchanging tube or the fin is reduced furthermore, it is possible to reduce the quantity of heat conduction between the first heat exchanging unit and the second heat exchanging unit, whereby the heat exchanging performance of the heat exchanger as a whole can be maintained highly.

Each of the heat exchanging tubes may be covered with a cladding layer of brazing material.

Then, owing to the interposition of the cladding layer between each heat exchanging tube and the adjoining fin, the heat exchanging tube can be joined to the adjoining fins by brazing, improving the strength of the core part.

These and other objects and features of the present invention will become more fully apparent from the following description and appended claims taken in conjunction with the accompany drawings.

DETAILED DESCRIPTION OF THE PREFERRED EMBODIMENT

Referring to accompanying drawings, an embodiment of the present invention will be described below.

Figure 1:
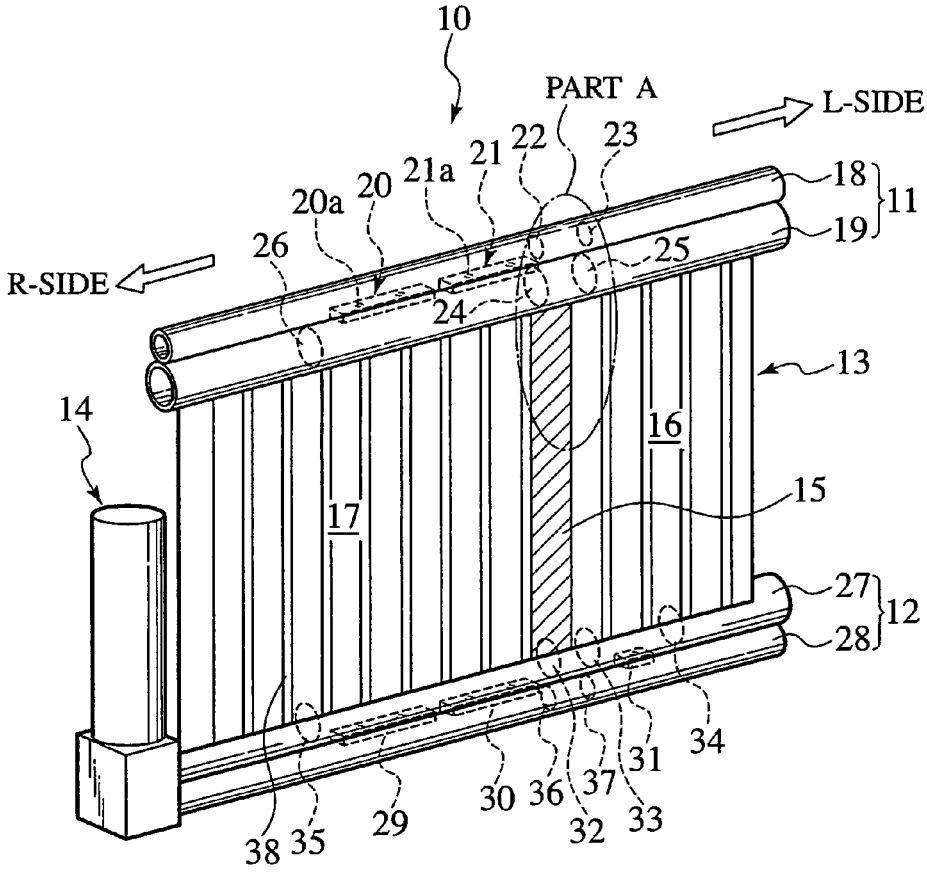
FIG. 1 is a perspective view of a heat exchanger in accordance with the first embodiment of the present invention.

FIG. 1 is a perspective view of a compound type heat exchanger 10 in accordance with the first embodiment of the present invention. As shown in this figure, the heat exchanger 10 of this embodiment includes an upper header pipe 11 on the upper side, a lower header pipe 12 on the lower side, a core part 13 connecting the upper header pipe 11 with the lower header pipe 12 in the vertical direction and a liquid tank 14 connected to the lateral side of the lower header pipe 12. In FIG. 1, fins are eliminated in order to exhibit the constitution of the heat exchanger 10 clearly. A heat exchanger's part on the left side ("L" side shown in FIG. 1) of a pseudo heat exchanging passage member 15 constitutes an oil cooler unit 16 (as the first heat exchanging unit), while another heat exchanger's part on the right side ("R" side shown in FIG. 1) of the pseudo heat exchanging passage member 15 constitutes a condenser unit 17 (as the second heat exchanging unit). The condenser unit 17 serves to cool a cooling medium for air conditioning cycle, while the oil cooler unit 16 cools a transmission oil for an automatic car.

The upper header pipe 11 has an upper pipe 18 and a lower pipe 19 both of which are adjacent to each other in the vertical direction. The upper pipe 18 is communicated with the lower pipe 19 through joint members 20, 21 having a plurality of through-holes 20*a*, 21*a*, respectively. The upper pipe 18 is closed up by two disk-shaped partition walls 22, 23 positioned in the way of the pipe 18 in the longitudinal direction. These partition walls 22, 23 are apart from each other. Similarly, the lower pipe 19 is provided, therein, with partition walls 24, 25 at respective positions corresponding to the partition walls 22, 23 of the upper pipe 18. The lower pipe 19 further includes one partition wall 26 closer to the liquid tank 14. The above joint member 20, 21 are disposed between the partition wall 24 and the partition wall 26. Again, the partition walls 22, 23 and the partition walls 24, 25 are arranged apart from each other at predetermined intervals, respectively.

Similarly to the upper header pipe 11, the lower header pipe 12 is formed by an upper pipe 27 and a lower pipe 28 both of which are adjacent to each other. The upper pipe 27 is communicated with the lower pipe 28 through joint members 29, 30 and 31. Further, partition walls 32–37 are arranged in the pipes 27, 28, as shown in the figure. Juxtaposed in the core part 13 are a plurality of heat exchanging tubes 38 that extend vertically and allow the heat exchanging medium to flow therein. Each of corrugated fins (see FIG. 2) is arranged between the adjoining heat exchanging tubes 38. Noted that not only the partition walls 32, 33 but the partition walls 36, 37 are apart from each other at predetermined intervals, respectively.

Figure 2:
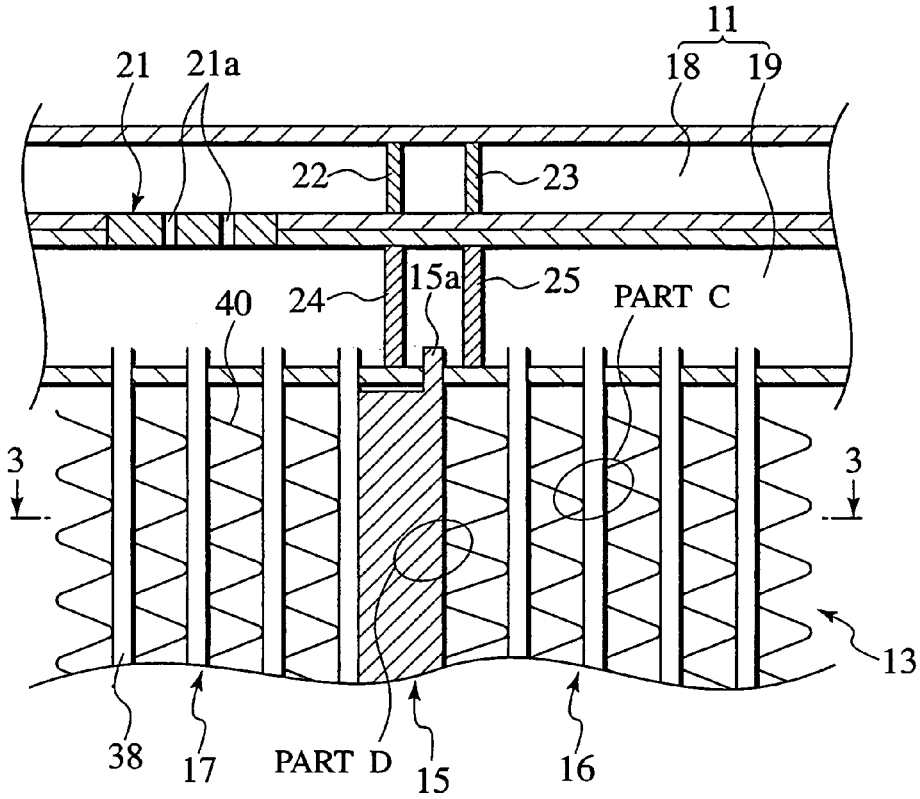
FIG. 2 is a sectional view of a part A of FIG. 1 in enlargement.
Figure 3:
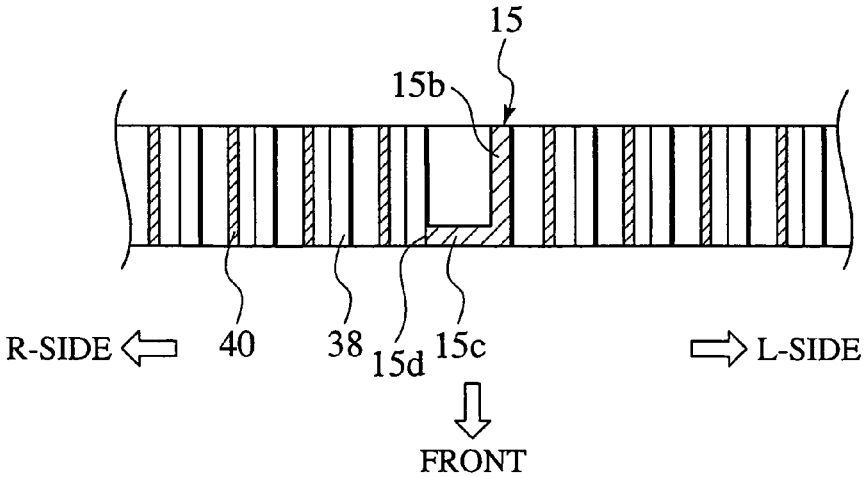
FIG. 3 is a sectional view taken along a line 3—3 of FIG. 2.

FIG. 2 is an enlarged sectional view of a part A of FIG. 1. As mentioned above, the upper and lower pipes 18, 19 are provided with the partition walls 22–25. The pseudo heat exchanging passage member 15 is arranged below the substantial middle points between the opposing partition walls 22 and 23 and also between the opposing partition walls 24 and 25. The pseudo heat exchanging passage member 15 has its upper end 15*a* formed with a width substantially equal to the width of the heat exchanging tube 38, providing a substantial L-shaped section, as shown in FIG. 3. In detail, the pseudo heat exchanging passage member 15 has a lateral part 15*b* extending rearward of the vehicle and a front part 15*c* extending to the right direction of the vehicle, both of which are formed into one body, providing the substantial L-shaped section. Further, in the pseudo heat exchanging passage member 15, the front part 15*c* is arranged so that its leading end 15*d* abuts on the adjoining heat exchanging tube 38.

Figure 4:
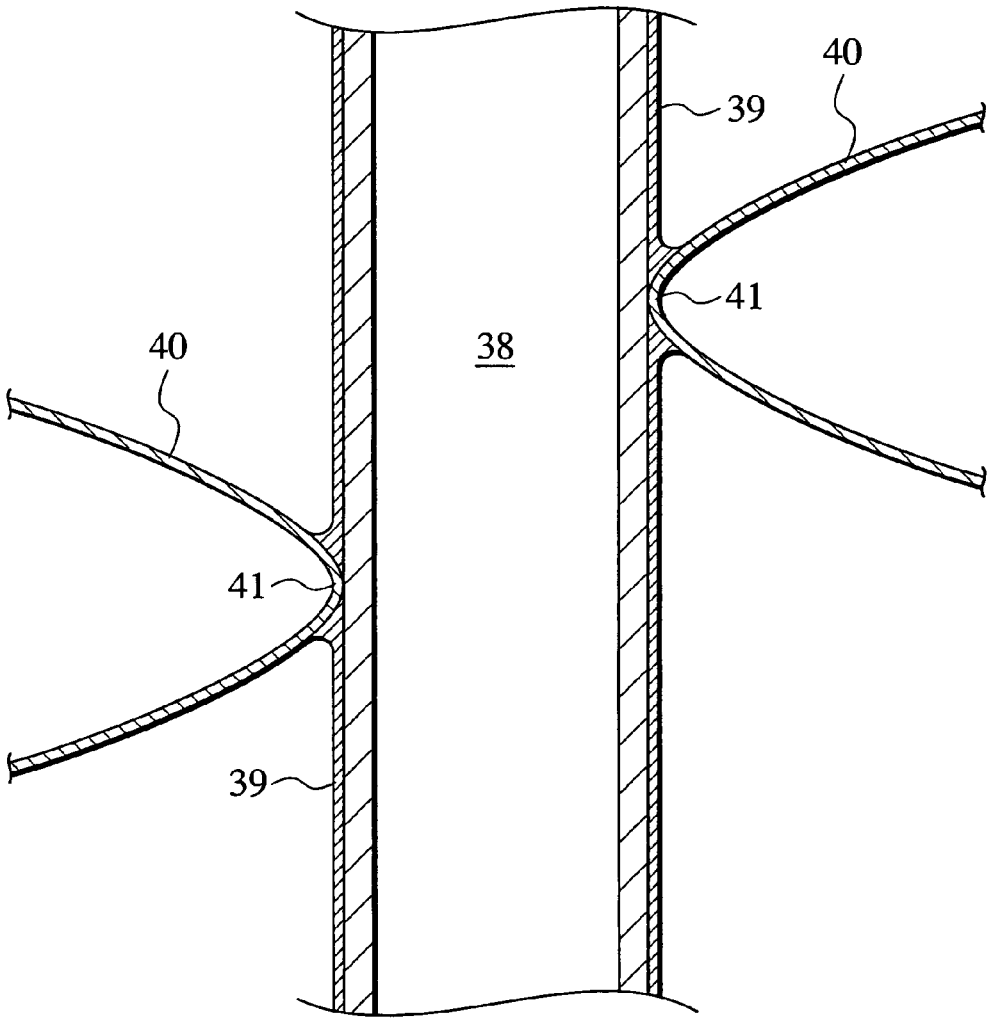
FIG. 4 is a sectional view of a part C of FIG. 2 in enlargement.

As shown in FIG. 4, each of the heat exchanging tubes 38 has a hollow interior and its outer surface coated with a cladding layer 39 made of a brazing material, through which the fins 40 are joined to the tube 38. In assembling, respective peaks 41 of the fins 40 abut on the cladding layer 39 of the brazing material (e.g. aluminum alloys) on the outer surface of the heat exchanging tube 39. In this state, by heating the whole heat exchanger, only the cladding layer 39 is molten, so that the fins 40 are joined to each of the tubes 38 by brazing.

Figure 5:
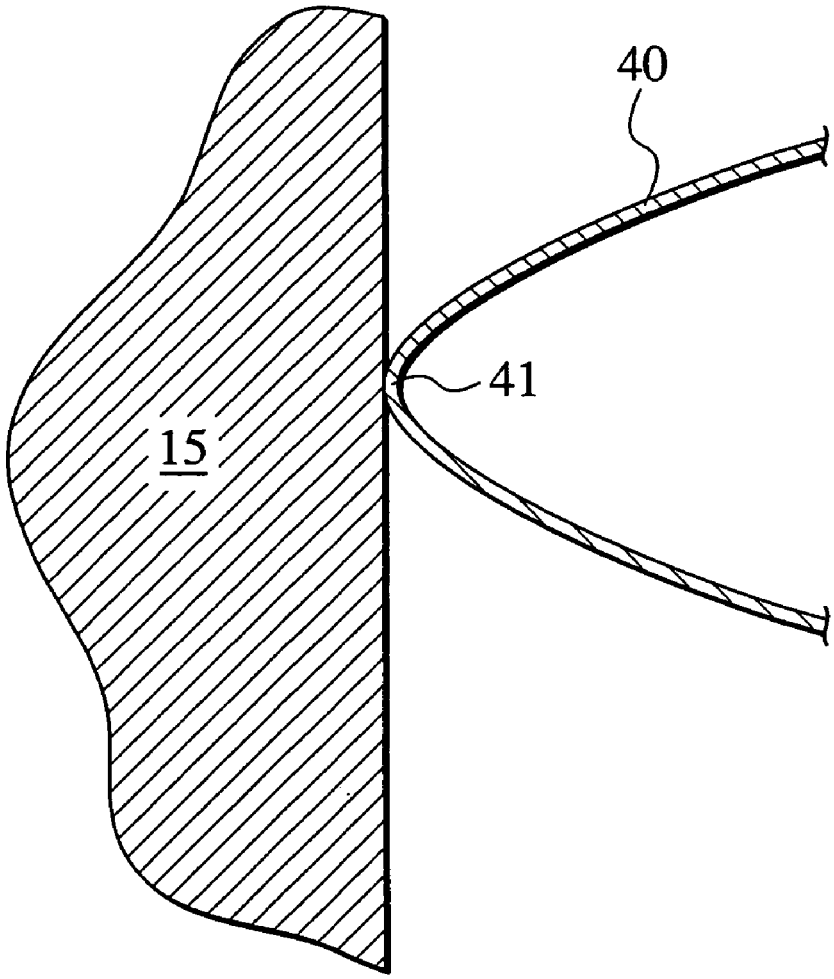
FIG. 5 is a sectional view of a part D of FIG. 2 in enlargement.

Meanwhile, as shown in FIG. 5 as a result of enlarging a part D of FIG. 2, it is noted that the adjoining fin 40 on the left side of the pseudo heat exchanging passage member 15 in the traveling direction of the vehicle (right side in the figure) is not brazed, at a peak 41 of the fin 40, to the member 15 but abutment.

Figure 6:
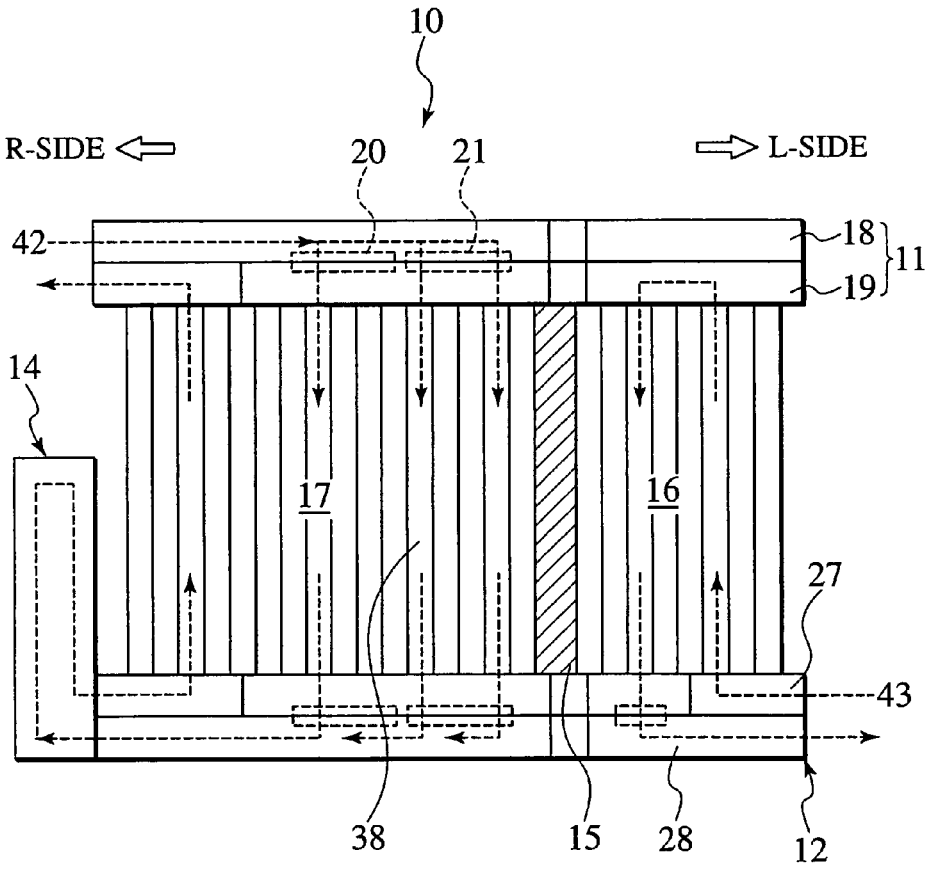
FIG. 6 is a schematic view showing the flows of medium and oil in the heat exchanger of the first embodiment.

Referring to FIG. 6, the flows of a medium 42 and oil 43 in the heat exchanger 10 of the embodiment will be described. In FIG. 6, the above-mentioned fins 40 are eliminated in order to clarify such flows of the medium 42 and the oil 43.

As shown in the figure, in the condenser unit 17 on the "R" side of the figure (i.e. the right side in the traveling direction), the medium 42 flowing into the upper pipe 18 of the upper header pipe 11 passes through the joint members 20, 21 and the lower pipe 19 and successively flows in the heat exchanging pipes 38 downwardly. Subsequently, the medium 42 flows from the lower header pipe 12 to the liquid tank 14 and thereafter, the medium 42 flows in the heat exchanging pipes 38 upwardly. After that, the medium 42 is returned to an air-conditioning cycle through the lower pipe 19 of the upper header pipe 11.

On the other hand, in the oil cooler unit 16 on the "L" side of the figure (i.e. the left side in the traveling direction), the oil 43 entering from the upper pipe 27 of the lower header pipe 12 flows in the heat exchanging tubes 38 upwardly and turns back at the lower pipe 19 of the upper header pipe 11. Subsequently, after flowing in the heat exchanging pipes 38 downwardly, the oil is returned to a transmission through the lower pipe 28 of the lower header pipe 12. Noted that the temperature of the medium 42 flowing the condenser unit 17 is about 60° C., while the temperature of the oil flowing the oil cooler unit 16 is about 110° C. being a remarkable high temperature.

According to the heat exchanger 10 of the first embodiment, owing to the provision of the pseudo heat exchanging passage member 15 between the oil cooler unit 16 and the condenser unit 17, there is almost no heat conduction from the oil cooler unit 16 of high temperature to the condenser unit 17 of relatively how temperature, whereby the heat exchanging performance of the heat exchanger 10 as a whole can be maintained. Noted that, in the conventional heat exchanger, there is a possibility of heat conduction from an oil cooler unit of high temperature to a condenser unit through the intermediary of a pseudo heat exchanging passage member because the pseudo heat exchanging passage member is welded to fins on respective sides of the oil cooler unit 16 and the condenser unit 17. While, in accordance with the heat exchanger 10 of this embodiment, by eliminating one fin to be arranged on the right side of the pseudo heat exchanging passage member (closer to the condenser unit 17) and further arranging the above member 15 having a substantial L-shaped section instead of the fin, the quantity of heat conduction from the oil cooler unit 16 and the condenser unit 17 can be reduced remarkably.

Generally noted that the elimination of fin(s) would make the flow of cooling wind passing through the core part 13 smooth thereby reducing the draft resistance too much. Nevertheless, according to this embodiment, the pseudo heat exchanging passage member 15 having a substantial L-shaped section serves to suppress such an excessive reduction of draft resistance.

$2^{nd}$. Embodiment

The second embodiment of the present invention will be described below. In this embodiment, elements identical to those in the first embodiment will be indicated with the same reference numerals respectively and their overlapping descriptions are eliminated.

The second embodiment differs from the first embodiment in the shape of the pseudo heat exchanging passage member.

Figure 7:
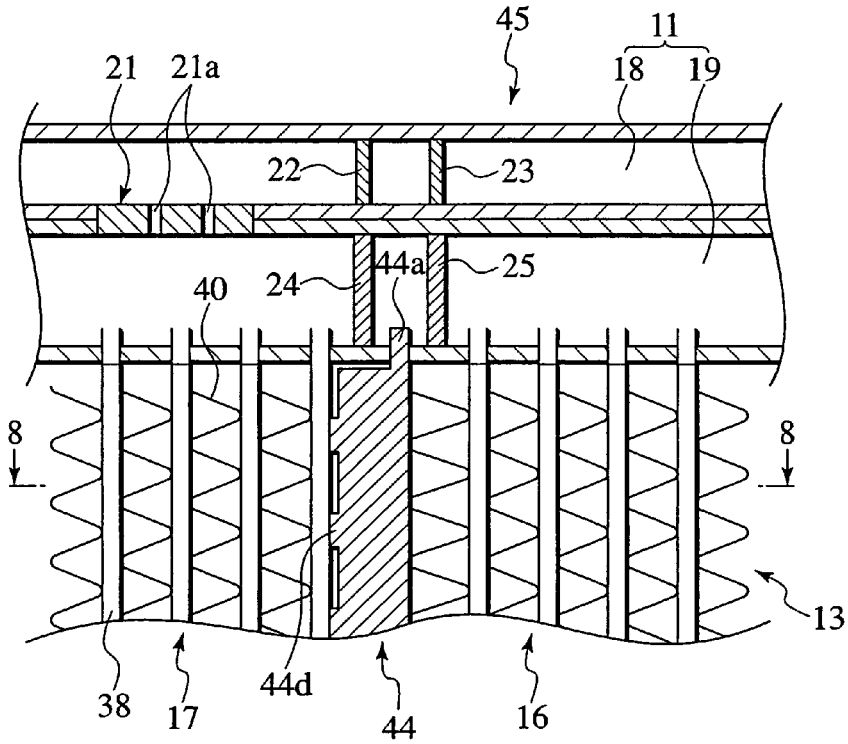
FIG. 7 is a sectional view showing the substantial part of the heat exchanger in accordance with the second embodiment of the present invention.
Figure 8:
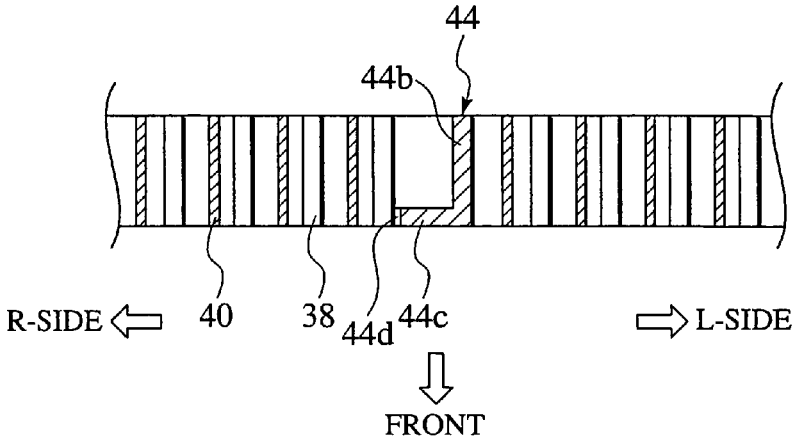
FIG. 8 is a sectional view taken along a line 8—8 of FIG. 7.

As shown in FIG. 7, a heat exchanger 45 is also provided with a pseudo heat exchanging passage member 44 whose upper end 44*a* has a width substantially equal to the width of the heat exchanging tube 38, which is similar to the pseudo heat exchanging passage member 15 of the first embodiment. As shown in FIG. 8, the pseudo heat exchanging passage member 44 further includes a lateral part 44*b* extending rearward of the vehicle and a front part 44*c* extending to the right direction of the vehicle, both of which are formed into one body, providing the substantial L-shaped section. Additionally, the front part 44*c* is provided, at a tip thereof, with a plurality of projections 44*d* which abut on the adjoining heat exchanging tube 38.

According to the heat exchanger 45 constructed above, owing to the formation of the projections 44*d*, it is possible to reduce a contact area of the pseudo heat exchanging passage member 44 with the adjoining heat exchanging tube 38 in comparison with the contact area of the first embodiment, whereby the quantity of heat conduction from the oil cooler unit 16 to the condenser unit 17 can be reduced furthermore.

$3^{rd}$. Embodiment

The third embodiment of the present invention will be described below. In this embodiment, elements identical to those in the second embodiment will be indicated with the same reference numerals respectively and their overlapping descriptions are eliminated.

The third embodiment differs from the second embodiment in the shape of the pseudo heat exchanging passage member.

Figure 9:
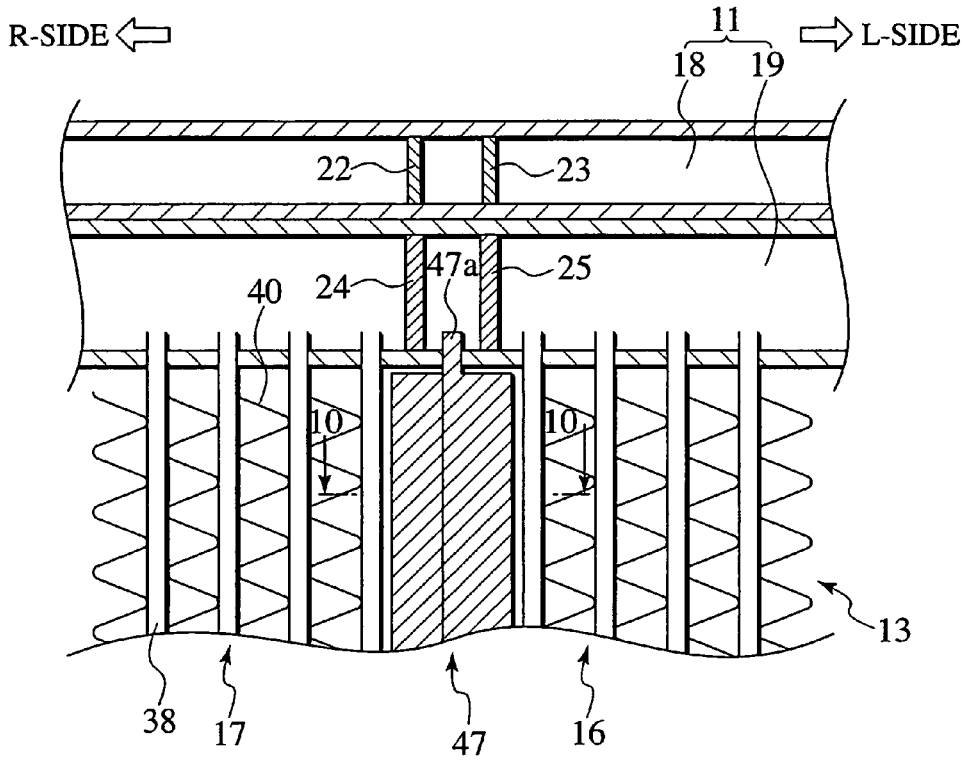
FIG. 9 is a sectional view showing the substantial part of the heat exchanger in accordance with the third embodiment of the present invention.
Figure 10:
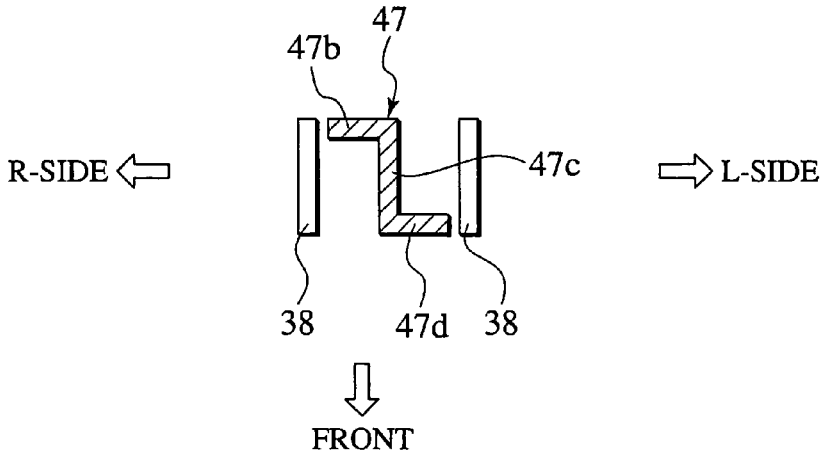
FIG. 10 is a sectional view taken along a line 10—10 of FIG. 9.

As shown in FIG. 9, a heat exchanger 46 is also provided with a pseudo heat exchanging passage member 47 whose upper end 47*a* has a width substantially equal to the width of the heat exchanging tube 38, which is similar to the pseudo heat exchanging passage members 15, 44 of the first and second embodiments. As shown in FIGS. 9 and 10, the pseudo heat exchanging passage member 47 further includes a rear part 47*b* arranged on the rear side of the vehicle to extend to the right in the vehicle's traveling direction (left in the figure), a body part 47*c* extending from the left end (right in the figure) of the part 47*b* to the forward of the vehicle and a front part 47*d* extending from the front end of the part 47*c* to the left in the vehicle's traveling direction (right in the figure), all of which are formed into one body, providing a substantial Z-shaped section. Additionally, the right end (left in the figure) of the rear part 47*b* and the left end (right in the figure) of the front part 47*d* are arranged apart from the adjoining heat exchanging tubes 38 at intervals, respectively. As one modification, the right end of the rear part 47*b* and the left end of the front part 47*d* may be arranged so as to abut on the adjoining heat exchanging tubes 38.

According to the heat exchanger 46 constructed above, there are eliminated left and right fins to be arranged on both sides of the boundary between the oil cooler unit 16 and the condenser unit 17 and one heat exchanging tube to be arranged between these left and right fins, while there is provided the pseudo heat exchanging passage member 47 having a substantial Z-shaped section instead of these fins and the heat exchanging tube therebetween. Again, since both left and right ends of the pseudo heat exchanging passage member 47 do not abut on the adjoining heat exchanging tubes 38, 38, the quantity of heat conduction from the oil cooler unit 16 to the condenser unit 17 is reduced furthermore. Even if arranging the right end of the rear part 47*b* and the left end of the front part 47*d* so as to abut on the adjoining heat exchanging tubes 38 in the above modification, it is possible to reduce the quantity of heat conduction from the oil cooler unit 16 to the condenser unit 17 since the pseudo heat exchanging passage member 47 is not brazed to the adjoining heat exchanging tubes 38, 38 but only existing either line-contact or point-contact therebetween. Additionally, it is noted that the provision of the pseudo heat exchanging passage member 47 having a substantial Z-shaped section allows an excessive reduction in draft resistance to be suppressed.

Finally, it will be understood by those skilled in the art that the foregoing descriptions are nothing but three embodiments of the disclosed heat exchanger and therefore, various changes and modifications may be made within the scope of claims. For example, in the modification of the compound type heat exchanger 46 of the third embodiment, the pseudo heat exchanging passage member 47 may be provided, at the right end of the rear part 47*b* and the left end of the front end 47*d*, with projections abutting on the adjoining heat exchanging tubes 38, 38.

What is claimed is:

1. A compound type heat exchanger, comprising:

a core part having a plurality of heat exchanging tubes each formed to allow passage of a heat exchanging medium therein, the heat exchanging tubes being juxtaposed to each other, and a plurality of fins each interposed between the adjoining heat exchanging tubes so that the heat exchanging tubes and the fins are stacked alternately;

a pair of header pipes arranged on both ends of the heat exchanging tubes and connected to respective ends of the heat exchanging tubes;

a pseudo heat exchanging passage member having a substantially L-shaped section and being positioned within the core part so that a width of a front edge of the pseudo heat exchanging passage member is approximately equal to a width of one of the heat exchanging tubes and one of its associated fins; and partition walls each arranged in the header pipes so as to be close to the pseudo heat exchanging passage member thereby to divide spaces inside the header pipes, wherein the pseudo heat exchanging passage member divides the core part and the partition walls divide the header pipes to form a first heat exchange unit and a second heat exchange unit.

2. The compound type heat exchanger of claim 1, wherein the pseudo heat exchanging passage member is provided with projections that abut on the heat exchanging tube adjoining the pseudo heat exchanging passage member.

3. The compound type heat exchanger of claim 1, wherein each of the heat exchanging tubes is covered with a cladding layer of brazing material.

4. The compound type heat exchanger of claim 1, wherein top and bottom ends of the pseudo heat exchanging passage member have a width substantially equal to a width of one of the heat exchanging tubes.

5. A compound type heat exchanger, comprising:

a core part having a plurality of heat exchanging tubes each formed to allow passage of a heat exchanging medium therein, the heat exchanging tubes being juxtaposed to each other, and a plurality of fins each interposed between the adjoining heat exchanging tubes so that the heat exchanging tubes and the fins are stacked alternately;

a pair of header pipes arranged on both ends of the heat exchanging tubes and also connected to respective ends of the heat exchanging tube;

a pseudo heat exchanging passage member having a substantially Z-shaped section and being positioned within the core part so that a width of the pseudo heat exchanging passage is greater than a width of one of the heat exchanging tubes and one of its associated fins and less than the width of one of the heat exchanging tubes and both of its associated fins; and partition walls each arranged in the header pipes so as to be close to the pseudo heat exchanging passage member thereby to divide spaces inside the header pipes, wherein the pseudo heat exchanging passage member divides the core part and the partition walls divide the header pipes to form a first heat exchanging unit and a second heat exchanging unit.

6. The compound type heat exchanger of claim 5, wherein the pseudo heat exchanging passage member is arranged so that there is a space between each side thereof and the heat exchanging tubes adjoining the pseudo heat exchanging passage member.

7. The compound type heat exchanger of claim 5, wherein the pseudo heat exchanging passage member is provided with projections on one side that abut on the heat exchanging tube adjoining the pseudo heat exchanging passage member.

* * * * *